US008101330B2

(12) United States Patent
Anno et al.

(10) Patent No.: US 8,101,330 B2
(45) **Date of Patent: *Jan. 24, 2012**

(54) TWO COMPONENT DEVELOPER AND IMAGE FORMING METHOD

(75) Inventors: Masahiro Anno, Tokyo (JP); Masahiko Nakamura, Tokyo (JP); Tsuyoshi Uchida, Tokyo (JP); Kenichi Onaka, Tokyo (JP); Junya Onishi, Tokyo (JP); Naoya Tonegawa, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 440 days.

This patent is subject to a terminal disclaimer.

(21) Appl. No.: 12/397,989

(22) Filed: Mar. 4, 2009

(65) Prior Publication Data

US 2009/0233202 A1 Sep. 17, 2009

(30) Foreign Application Priority Data

Mar. 14, 2008 (JP) ..... 2008-065585

(51) Int. Cl.
*G03G 9/00* (2006.01)

(52) U.S. Cl. ..... 430/108.7; 430/108.1; 430/111.1; 430/111.3

(58) Field of Classification Search ..... 430/108.1, 430/108.6, 108.7, 111.1, 111.3, 111.31, 111.4
See application file for complete search history.

(56) References Cited

U.S. PATENT DOCUMENTS

| | | | | |
|---|---|---|---|---|
| 6,844,126 | B2 * | 1/2005 | Ohmura et al. | 430/110.3 |
| 6,897,001 | B2 * | 5/2005 | Mizoe et al. | 430/108.6 |
| 7,160,663 | B2 * | 1/2007 | Komoto et al. | 430/109.1 |
| 2008/0038653 | A1 * | 2/2008 | Yamazaki et al. | 430/106.2 |
| 2009/0208862 | A1 * | 8/2009 | Anno et al. | 430/108.7 |

FOREIGN PATENT DOCUMENTS

| | | |
|---|---|---|
| JP | 2002214842 | 7/2002 |
| JP | 2005352473 | 12/2005 |

* cited by examiner

*Primary Examiner* — Mark F Huff
*Assistant Examiner* — Stewart Fraser
(74) *Attorney, Agent, or Firm* — Lucas & Mercanti, LLP

(57) ABSTRACT

A two component developer comprising a toner and a carrier, wherein the toner includes: colored particles; and external additive particles comprising a complex oxide incorporating silicon atoms and at least one of titanium atoms and aluminum atoms, and a surface existing ratio of the silicon atoms ($R_2$) in a surface of the external additive particles being larger than an average existing ratio of the silicon atoms ($R_1$) in an entirety of the external additive particles, and carrier particles comprise magnetic material powder dispersed in a phenol-formaldehyde resin, and have an average of the shape coefficient SF-1 of 1.0 to 12 and an average of the shape coefficient SF-2 of 1.1 to 2.5, and a volume based median diameter of from 10 to 100 μm.

9 Claims, 1 Drawing Sheet

TWO COMPONENT DEVELOPER AND IMAGE FORMING METHOD

This application is based on Japanese Patent Application No. 2008-065585 filed on Mar. 14, 2008 with Japan Patent Office, the entire content of which is hereby incorporated by reference.

TECHNICAL FIELD

The present invention relates to a two component developer.

In recent years, specifically along with progress of networks capable of readily sending digital system data, image forming methods employing an electrophotographic system have widened the application region from simple copying action to formation of original images and the use as a so-called substituting printing.

Consequently, in the above technology, it has been desired to form stable images over an extended period. Further, it is desired to extend the replenishing cycle of developers as long as possible.

On the other hand, in the image forming method employing the electrophotographic system, in order to form stable images, it has been considered that it is preferable to employ a two component developer composed of a carrier and a toner. The reason is that since the carrier exhibits charge providing capability, it is capable of assuredly providing charge to the toner, and further, since many frictional electric charges providing sites exist, it is possible to realize a rapid charge rise, whereby it is considered to be appropriate for high speed development.

There are, however, problems that toner components adheres to the carrier to cause carrier's deterioration or external additive fine particles are embedded into toner particles by repeated collision of carrier particles to toner particles whereby toner deteriorates when the two component developer is employed for electrophotographic image forming method.

It is proposed to reduce stress on toner particles by employing a light weight carrier, so called a resin dispersed carrier, to dissolve the problems, as described in Patent Documents 1 and 2.

The resin dispersed carrier has low specific gravity by dispersing magnetic powder in a resin. Particularly resin dispersed carrier prepared by polymerization method is effective in reducing stress to toner particles since it is sphere like shape in comparison with a resin dispersed carrier prepared by pulverization method.

A resin dispersed carrier employing phenol formaldehyde as a binding resin is said preferable because it has high hardness and durability among the resin dispersed carriers.

However, there is a problem that developability deteriorates for long term use even when the resin dispersed carrier employing the phenol formaldehyde resin.

Patent Document 1: JP A 2002-214842

Patent Document 2: JP A 2005-352473

In view of the foregoing, the present invention was achieved. An object of the present invention is to provide a two component developer which retards the deterioration of developing characteristics during the use over an extended period so that it is possible to form high quality images of high resolution without image defects over an extended period.

SUMMARY

The inventors has analyzed the problems caused by resin dispersed carrier and has found that charge accumulate on the resin dispersed carrier particles, and charge amount increases due to excess charge accumulation for long time use and it is estimated to cause of deterioration of developability.

It is estimated by the following reason to cause charge accumulation on the resin dispersed carrier particles The resin dispersed carrier is high resistance as a whole because it comprises resin While charge can be diffused inside of carrier particles in resin coated carrier which contain a conductive core, the resin dispersed carrier is liable to accumulate charge because it comprises resin having insulation property dispersing magnetic powder in carrier particles as a whole.

The inventor has attained this invention by consideration to inhibit excess charge of external additive particles to inhibit the carrier's charge accumulation.

The two component developer comprises a toner and a carrier. The carrier particles comprise magnetic material powder dispersed in a phenol-formaldehyde resin, and have an average of the shape coefficient SF-1 of 1.0 to 1.2 and an average of the shape coefficient SF-2 of 1.1 to 2.5, and a volume based median diameter of from 10 to 100 μm. The toner comprises colored particles and external additive particles, which comprises a complex oxide containing silicon atoms and at least one of titanium atoms and aluminum atoms, and $(R_1)/(R_2)$ is not more than 1. In this instance $(R_3)$ is an average existing ratio of the silicon atoms in an entirety of the external additive particles defined as a value obtained from a weight of silicon atoms in the entirety of the external additive particles divided by the total weight of the silicon atoms, the titanium atoms and the aluminum atoms in the entirety of the external additive particles, and $(R_2)$ is a surface existing ratio of the silicon atoms in a surface of the external additive particles defined as a value obtained from a weight of silicon atoms in the surface divided by the total weight of the silicon atoms, the titanium atoms and the aluminum atoms in the surface.

One of the embodiments of the present invention, the external additive particles preferably have a value of $(R_1)/(R_2)$ of not more than 0.7, where $R_1$ is an average existing ratio of silicon atoms in the whole of the external additive particles, and $R_2$ is a surface existing ratio of silicon atoms in a surface of the external additive particles.

One of the embodiments of the present invention, the external additive particles preferably contain a total amount by weight of the titanium atoms and the aluminum atoms contained in the external additive particles is higher than an amount of the silicon atoms in the external additive particles. It is further preferable that the external additive particles have a number average primary particle diameter of 20 to 200 nm.

The two component developer comprises a carrier and a toner. The carrier has specific shape and resin dispersion type, which has high durability due to high fastness due to high cross-linking structure of comprising form-aldehyde resin. The toner comprises external additive particles, in which a surface existing ratio of the silicon atoms in a surface of the external additive particles is larger than an existing ratio of the silicon atoms in an entirety of the external additive particles, whereby an accumulation of charge on the carrier particles since generation of excess charging is inhibited, and stable developability can be obtained over an extended period. It is possible as the result, to form high quality images of high resolution stably over an extended period since the external additive has sufficient charge ability.

It is estimated by the following reason to cause charge accumulation on the resin dispersed carrier particles. The resin dispersed carrier is high resistance as a whole because it comprises resin. While charge can be diffused inside of carrier particles in resin coated carrier which contain a conductive core, the resin dispersed carrier is liable to accumulate charge because it comprises resin having insulation property dispersing magnetic powder in carrier particles as a whole.

The reason why the external additives in the toner inhibit excess charging despite its sufficient charge ability is estimated as follows. The external additive particles is easily charged by property of a compound comprising silicon atom such as silica existing in a surface of the external additive particles, and while sufficient charge is given by property to maintain charge easily, an excess charge is inhibited by charge leak to inside of particles due to titanium atom and/or aluminum atom existing inside of the particles.

The charge can be kept inside of the particles but not surface when employing low resistance fine particles of metal oxide such as titanium oxide of aluminum oxide as the external additive particles, however, good charge ability and fluidity are not obtained such that ability to charge colored particles constituting toner changes depending on environmental change.

DESCRIPTION OF THE PRESENT EMBODIMENTS

Figure 1:
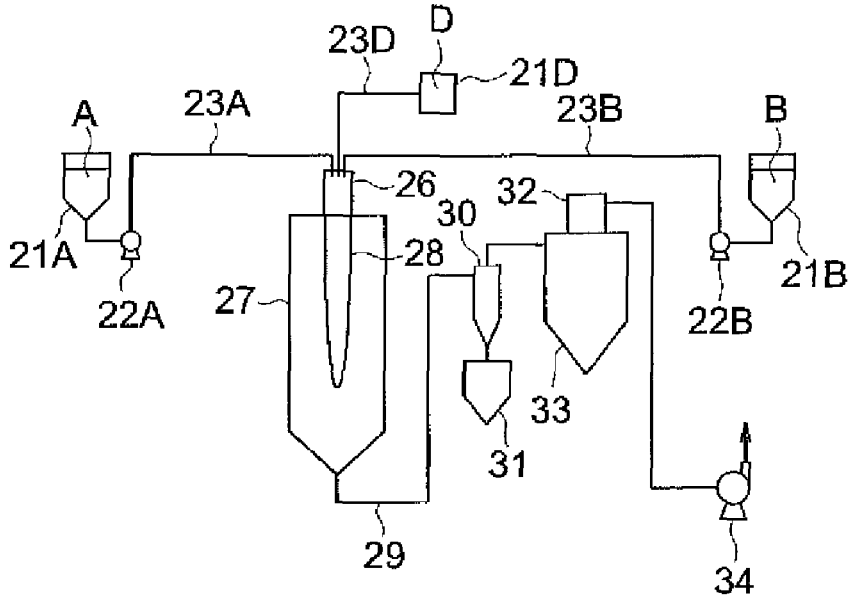
FIG. 1 is a schematic view showing one example of manufacturing facilities which manufacture minute external additive particles which constitute the toner of the two component developer of the present invention employing a gas phase method via powders.

The present invention will now be detailed.

Two-Component Developer

The two component developer comprises a toner and a carrier. The carrier particles comprise magnetic material powder dispersed in a phenol-formaldehyde resin, and have an average of the shape coefficient SF-1 of 1.0 to 1.2 and an average of the shape coefficient SF-2 of 1.1 to 2.5, and a volume based median diameter of from 10 to 100 μm. The toner comprises colored particles and external additive particles, which comprises a complex oxide containing silicon atoms and at least one of titanium atoms and aluminum atoms, and $(R_1)/(R_2)$ is not more than 1. In this instance $(R_1)$ is an average existing ratio of the silicon atoms in an entirety of the external additive particles defined as a value obtained from a weight of silicon atoms in the entirety of the external additive particles divided by the total weight of the silicon atoms, the titanium atoms and the aluminum atoms in the entirety of the external additive particles, and $(R_2)$ is a surface existing ratio of the silicon atoms in a surface of the external additive particles defined as a value obtained from a weight of silicon atoms in the surface divided by the total weight of the silicon atoms, the titanium atoms and the aluminum atoms in the surface.

Since the above minute external additive particles are ones in which silicon atoms exist at the surface in a large amount, toner, which is prepared in such a manner that these are subjected to an external treatment to colored particles, is statically stored, excellent fluid characteristics, which are similar to particles via silica, are exhibited in such a manner that a packing phenomenon, which is generated when minute external additive particles composed, for example, of titanium oxide, is not generated.

(Minute External Additive Particles)

In the minute external additive particles, "existing ratio of silicon atoms at the surface is higher than that of silicon atoms in the whole" means that more silicon atoms exist at the surface and $(R_1)/(R_2)$ is less than 1, where $R_1$ is an existing ratio of silicon atoms in particles as a whole, while $R_2$ is a surface existing ratio of silicon atoms at the surface.

The value of $(R_1)/(R_2)$ is preferably at most 0.7, is more preferably at most 0.5, and is most preferably at most 0.25.

An average existing ratio of the silicon atoms $(R_1)$ is preferably from 1 to 20 weight %.

An existing ratio $R_1$ of silicon atoms in the entire external additive particles is determined as follows. The content by weight of silicon atoms, titanium atoms and/or aluminum atoms in the whole is determined via a fluorescent X-ray analysis (XRF) apparatus "XRF-1800" (produced by Shimadzu Corp.) and existing ratio $R_1$ is calculated in terms of mass fraction.

The determination is carried out via the following (1) (3) procedures in practice.

(1) Firstly, as a sample to prepare a calibration curve, pellets are prepared by adding silicon dioxide of known weight to 100 parts by weight of styrene powders. In the same manner as above, pellets to determine titanium atoms, which is prepared by adding titanium dioxide of known weight to 100 parts by weight of styrene powders and/or pellets to determine aluminum atoms which are prepared by adding aluminum oxide of known weight to 100 parts by weight of styrene powders were prepared.

(2) Subsequently, each of the prepared pellets prepared to determine silicon atoms, the pellets prepared to determine titanium atoms and/or the pellet prepared to determine aluminum were subjected to fluorescent X-ray analysis, and with regard to silicon dioxide, titanium oxide or aluminum oxide in the styrene powders, a calibration curve is prepared via the peak intensity obtained from each of the pellets.

(3) Thereafter, the minute external additive particle sample is subjected to fluorescent X-ray analysis, and by collating the resulting peak intensity with the calibration curve, the silicon atoms, the titanium atoms, and/or the aluminum atoms are subjected to quantitative analysis.

A Kα peak angle was determined via the 2θ table and employed in the above determination Further, conditions of the X-ray generating section were;

Rh tube voltage: 40 kV, tube electric current: 95 mA, and filter: not used, while spectroscopic conditions were;

slit: standard, attenuator: not used, spectroscopic crystal: (Si=PET, Ti=LiF, and Al=PET), and detector: (Si=FPC, Ti=SC, and Al=FPC).

A surface existing ratio $R_2$ of silicon atoms at the surface of the minute external additive particles was determined as follows. The content by weight of silicon atoms, titanium atoms, and aluminum atoms in the surface in the depth range of its surface to a depth of several nm (being an approximately 10-atom layer) was determined via an X-ray photoelectron spectrometer (XPS) "ESCA-1000" (produced by Shimadzu Corp.), whereby calculation was made in terms of mass traction.

Calibration curves of silicon atoms, titanium atoms and aluminum atoms were prepared, and under the following conditions, an external additive particle sample was subjected to X-ray photoelectron spectrometry in the same manner as in determination procedures (1) and (2) employing the above fluorescent X-ray analysis (XRF) instrument, in practice.

Determination conditions are;

X-ray intensity: 30 mA, 10 kV

Analysis depth: Normal mode

Quantitative element: simultaneous quantitative analysis of Si, Ti, and Al elements The average existing ratio of silicon atoms in the whole is preferably 1-49%, but is more preferably 1-20%, in the minute external additive particles.

The surface existing ratio of silicon atoms in the range of the surface to a depth of several nm in the surface is preferably 70-100%, but is more preferably 80-100%.

When the existing ratio of silicon atoms in the entire minute external additive particles has the values described above, the external additive particles exhibit sufficient charging property and fluidity of a toner which is prepared with the external addition to colored particles, and sufficiently retard excessive charge. When the surface existing ratio of silicon atoms in the surface is not less than 70%, sufficient charge providing capability to colored particles is obtained.

(Average Diameter of Minute External Additive Particles)

The number average diameter of the primary particles of the minute external additive particles is preferably 10-500 nm, is more preferably 20-300 nm, and is most preferably 20-200 nm.

When the number average diameter of the primary particles is regulated within the above range, it is possible to stabilize the charge at the surface of colored particles, and to retain the aforesaid minute external additive particles themselves at the surface of colored particles, while maintaining high stability.

The number average diameter of the minute external additive particles is determined via a scanning type electron microscope (SEM).

Practically an SEM photograph, which is enlarged by a factor of 30,000, is read via a scanner, and minute external additive particles existing on the toner surface of the aforesaid SEM photographic image are subjected to binarization via an image processing analyzing instrument "LUZEX AP" (produced by NIRECO Corp.). Subsequently, 100 Fere diameters in the horizontal direction of one type of the minute external additive particles are calculated, and the average value is designated as the number average diameter of the primary particles.

Incidentally, when the number average diameter of the primary particles of the minute external additive particles is small and they exist on the toner surface in the form of aggregates, the diameter of the primary particles forming the aforesaid aggregates is to be determined.

(Specific Surface Area of Minute External Additive Particles)

The BET specific surface area of the minute external additive particles is preferably 2-100 $m^2/g$.

"BET specific area", as described herein, refers to the specific surface area which is calculated by utilizing the BET adsorption isotherm formula from the adsorption amount of the gas of which adsorption occupied area is known.

By regulating the BET specific surface area of minute external additive particles within the above range, the minute external additive particles are not buried within the colored particles and are not released from the surface of the colored particles, whereby an ambience is formed so that stable actions are achieved as an external additive.

The BET specific surface area is the value which is determined via a multipoint method (being a 7-point method) employing an automatic specific area measuring apparatus "GEMINI 2360" (produced by Shimadzu-Micromeritics Co.).

In practice, initially, 2 g of minute external additive particles is placed in a straight sample cell, and as a pre-treatment, the cell interior is replaced with nitrogen gas (at a purity of 99.999%) over two hours. Thereafter, the calculation is made in such a manner that the minute external additive particles are subjected to adsorption and adsorption of nitrogen gas (at a purity of 99.999%) via the measurement apparatus itself.

(Bulk Density of Minute External Additive Particles)

Bulk density of the minute external additive particles is preferably 100-400 g/L.

The term, "bulk density", as described herein, refers to the value which is obtained by dividing the weight of minute external agent particles filled in a known volume container by the above volume and refers to the existing degree of void formed among minute external additive particles per unit volume in the case in which the minute external additive particles are in a packed state.

By regulating the bulk density of the minute external additive particles as described above, the toner has space among the toner particles certainly, whereby the packing of toner particles can be reduced during static storage and the resulting toner maintains high fluidity stably.

Bulk density of the external additive particles refers to the value which is determined via a Kawakita system bulk density meter "Type TH-2000" (produced by Seishin Enterprise Co., Ltd.).

In practice, a sample of the external additive is placed on a 120-mesh sieve, vibrated at vibration strength of 6 for 90 seconds, and allowed to fall into a container of known volume. After terminating the vibration, the resulting sample is allowed to stand still for 30 seconds. Thereafter, the sample in the container is leveled and the weight is determined, whereby the bulk density is calculated.

(Degree of Hydrophobicity of Minute External additive Particles)

Degree of hydrophobicity of the minute external additive particles is preferably at least 30%.

By regulating the degree of hydrophobicity of the minute external additive particles to at least 30%, an advantage result in which under an ambience of high temperature and high humidity, desired charging property is realized.

The degree of hydrophobicity of the minute external additive particles refers to the value determined as follows. Namely, 50 mL of water is put into a 200 mL beaker and further, 0.2 g of minute external additive particles (being the sample) is added. While stirring the resulting mixture via a magnetic stirrer, methanol is added from a burette of which tip is immersed into the water while dripping. Subsequently, the dripped amount (Me) of methanol is recorded when the initially floating minute external additive particles (being the sample) completely sink. Then, calculation is made based on following Formula (1).

$$\text{Degree of hydrophobicity (\%)}=[\text{Me (mL)}/(50+\text{Me (mL)})]\times 100 \qquad \text{Formula (1):}$$

The minute external additive particles are those in which the existing ratio of silicon atoms in the surface layer is higher than in the whole.

A preferable example of the minute external additive particles is that in which a surface composed of silica components is formed on the surface of a nucleus particle composed of titania and/or alumina components in practice. This embodiment is more advantageous. It is also preferable that the above nucleus particle is composed of oxides incorporating silicon atoms.

In the case of the above embodiment, the surface composed of silica components may not always completely cover the nucleus particle. The existing ratio of the silica components determined via an X-ray photoelectron spectrometer is preferably 70-100% by weight, but is more preferably 80-100%.

The existing ratio of silica is determined via a measurement method which is the same as that which determines existing ratio $R_2$ of silicon atoms in the surface of the aforesaid minute external additive particle while employing X-ray photoelectron spectrometer "ESCA-1000", produced by Shimadzu Corp.

(Manufacturing Method of Minute External Additive Particles)

Manufacturing methods of minute external additive particles incorporated in the two component developer of the present invention are not particularly limited, and examples thereof include a gas phase method, a pyrogenic process such as a flame hydrolysis method; a sol-gel method, a plasma method, a precipitation method; a hydrothermal method; a mining process; and combinations of the above processes. Of these, in view of easier regulation of exiting location of atoms, it is preferable to employ the pyrogenic process. Specifically listed may be the manufacturing method, employing the gas phase method, disclosed in JP A H08-253321.

The manufacturing method of minute external additive particles via the gas phase method, as described herein, refers to the method in which raw materials of minute external additive particles are introduced into a high temperature flame in a vapor or powder state, and minute external additive particles are manufactured by oxidizing the above.

When the minute external additive particles in which silicon atoms exists more localized at the surface are manufactured via a method (hereinafter also referred to as a "gas phase method via vapor") in which raw materials are introduced into a high temperature flame in a vapor state, in view of manufacturing stability, it is preferable that, for example, vapor which is prepared by vaporizing a titanium atom source and/or an aluminum atom source via heating is initially introduced, and after crystals grow to some extent, vapor, which is prepared by vaporizing the silicon atom source, is introduced.

As the silicon atom sources, listed are silicon halides such as silicon tetrachloride or organic silicon compounds; as titanium atom sources, listed are titanium sulfate and titanium tetrachloride; and further, as aluminum atom sources listed are aluminum chloride, aluminum sulfate, and sodium aluminate.

On the other hand, when the minute external additive particles, in which silicon atoms exists more localized at the surface, are manufactured via a method (hereinafter also referred to as "a gas phase method employing powders") in which raw materials in a powder state are introduced into a high temperature flame, it is preferable that for example, during introduction of powders which form nucleus particles (hereinafter also referred to "nucleus particle forming powders") and powders (hereinafter also referred to as "modifying powders") which form a surface via surface modification in a high temperature flame, in view of manufacturing stability, it is preferable that the particle size of the nucleus particle forming the powders is regulated to be greater than that of the modifying powders.

The above reason is assumed to be as follows. Nucleus particle forming powders and modifying powders are introduced an the same high temperature flame, and when a plurality of powders is subjected to coalescence and growth in the above high temperature flame to form particles of a larger diameter, by decreasing the particle size of the modifying powders, the heat receiving area of the modifying powders increases to result in a state which is more easily melted. Accordingly, for example, by regulating the temperature of the high temperature flame, the degree of coalescence and growth of nucleus particle forming powder is retarded to become low, whereby it is possibly to find melting and adhering conditions of the modifying powders without special trial and error.

In the foregoing, it is assumed that by simultaneously introducing the nucleus particle forming powders and the modifying powders into a high temperature flame, the surfaces are modified with each other.

In the aforesaid manufacturing method, as nucleus particle forming powders, employed are particles composed of metal oxides such as a component of titanium and/or alumina. As the above nucleus particle forming powders, preferred are those composed of oxides incorporating silicon atoms.

It is possible to prepare nucleus particle forming powders composed of metal oxides in such a manner that raw materials of the aforesaid metal oxides are combusted in a flame. As raw materials of metal oxides, listed may be those which are listed in the above as a titanium atom source, or an aluminum atom source. These may be employed individually or in any appropriate combinations.

On the other hand, as modifying powders, employed are those composed of silica. In practice, preferably employed are those which are prepared by combusting the silicon atom source, listed above, in a high temperature flame. In addition, in view of environmental safety, it is preferable to employ, as silica, those which are amorphous.

It is preferable that silica is subjected to adhesion and fusion via heat so that on the surface of the nucleus particles, it is not possible to observe the prototype of silica.

FIG. 1 is a schematic view showing one example of production facilities which manufacture, via the gas phase method employing powders, minute external additive particles incorporated in the toner of the two component developer of the present invention. Production facilities to manufacture the external additive particles according to the present invention are not limited thereto.

A case in which when minute external additive particles comprising, for example, silicon atoms, titanium atoms or aluminum atoms are manufactured, the following manufacture process can be practically used.

Nucleus particle forming powder A placed in tank 21A for nucleus particle forming powder A and modifying powder B placed in tank 21B for modifying powder B, each is introduced into main burner 26, fitted with a spray nozzle at the tip through introduction pipes 23A and 23B via metering supply pumps 22A and 22B, and further, is sprayed into a burner reactor 27 along with oxygen water vapor mixed gas D, whereby ignition is made via a subsidiary flame and high temperature flame 28 is formed.

Further, minute external additive particles are formed via burning, and the resulting minute external additive particles are cooled, together with the exhaust gas, in gas duct 29, separated from the exhaust gas via cyclone 30 and a bag filter 32. Each is collected via recovery units 31 and 33. The exhaust gas, separated from the minute external additive particles, is exhausted via an exhausting unit 34.

In FIG. 1, 21D is a tank of oxygen water vapor mixed gas D, while 23D is an introduction pipe of the oxygen water vapor mixed gas.

Figure 2:
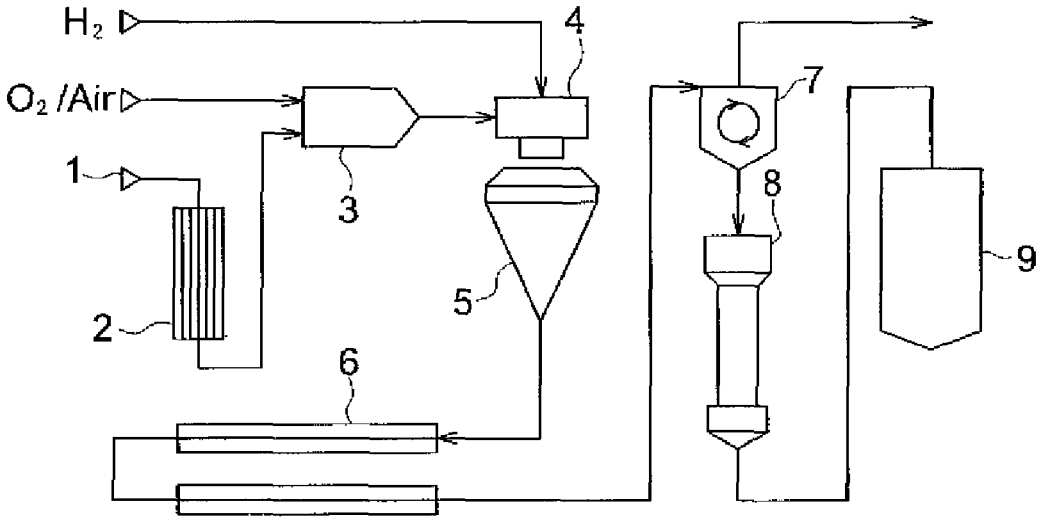
FIG. 2 is a schematic view showing one example of manufacturing facilities which manufacture the minute external additive particles which constitute the toner of the two component developer of the present invention employing a gas phase method via steam.

FIG. 2 is a schematic view showing one example of production facilities which manufacture minute external additive particles via the gas phase method employing vapor. Production facilities which manufacture the minute external additive particles according to the present invention via the gas phase method employing vapor are not limited thereto.

In the case that minute external additive particles comprising, for example, silicon atoms, titanium atoms, and aluminum atoms, in practice, production may be conducted via the above gas phase method employing vapor as follows.

(1) Initially, a silicon atom source, a titanium atom source, and an aluminum atom source are put into evaporator 2 through raw material slot 1 and are heated and vaporized to prepare a vapor containing silicon atom, a vapor containing titanium atom, and a vapor containing aluminum atom.

(2) Subsequently, these vapors are introduced into mixing chamber 3 together with inert gases (not shown), and a mixed gas is prepared by mixing the above, gas with desiccated air and/or oxygen gas, hydrogen gas at a predetermined ratio. The resulting mixed gases are introduced into a combustion flame (not shown) formed in reaction chamber 5 from combustion burner 4.

(3) By conducting combustion in a combustion flame in the temperature range of 1,000-3,000° C., particles containing silicon atoms, titanium atoms, and aluminum atoms are prepared.

(4) After cooling the prepared particles in cooling unit 6, gaseous reaction products are separated and removed in separating unit. 7. During the above operation, in some cases, hydrogen chloride, which is adhered onto the particle surface in moist air, is removed. Further, in processing chamber 8, hydrogen chloride undergoes deacidification treatment, collected by a filter, and complex oxide particles are recovered in silo 9.

In the manufacturing method described above, the flow rate ratio of vapor containing silicon atom, vapor containing titanium atom, and vapor containing aluminum atom, which are introduced into the combustion flame, the introducing timing of each vapor to the combustion flame, the combustion time, the combustion temperature, the combustion ambience, and other combustion conditions affect the localization of silicon atoms on the surface of the minute external additive particle. Consequently, in order to localize more titanium atoms and aluminum atoms into the interior and silicon atoms more at the surface, it is preferable that these conditions are subjected to composite regulation.

The state in which silicon atoms are localized more at the surface is realized via, for example, delayed timing of introduction of the vapor containing silicon atom into the combustion flame or an increase in concentration of the vapor containing silicon atom in the entire passing vapor during the latter half of the reaction.

In practice, in view of production stability, it is preferable that the vapor related to titanium, exhibiting relatively low electrical resistance, and/or vapor related to aluminum, are introduced into the combustion flame in advance (or the concentration of the vapor related to silica in the entire passing vapor is decreased during the first half of the reaction), and after crystals grow to some extent, the vapor related to silicon, exhibiting relatively high electrical resistance is introduced, that is, the concentration of the vapor containing silicon atom in the entire passing vapor during the first half of the reaction is made higher.

The resulting composite oxide particles may be employed as minute external additive particles without modification. However, it is preferable that the above composite oxide particles are subjected to a hydrophobic treatment.

As a hydrophobic treatment method, listed may be the dry system method described below.

Namely, hydrophobic agents are diluted with solvents such as tetrahydrofuran (THF), ethyl acetate, methyl ethyl ketone, acetone ethanol, or hydrogen chloride saturated ethanol. During vigorous stirring of the composite oxide particles in a blender, the above diluted solution of hydrophobic agents is added via dripping or spraying, and sufficient mixing is conducted. During the above operation, it is possible to employ apparatuses such as a kneading coater, a spray drier, a thermal processor, or a fluid bed.

Subsequently, the resulting mixture is transferred to a vat and dried by heating in an oven. Thereafter, sufficient pulverization is again carried out via a mixer or a jet mill. It is preferable that, if needed, the resulting pulverized ones are subjected to classification. In the method described above, when a hydrophobic treatment is carried out employing a plurality of types of hydrophobic agents, the treatments may be carried out by simultaneously employing each of them or the above treatments may be separately carried out.

Further, other than the above dry system method, the hydrophobic treatment may be carried out via wet system methods such a method in which composite oxide particles are immersed into an organic solvent solution of coupling agents, followed by drying, and another method in which composite oxide particles are dispersed into water to form slurries followed by dripping of an aqueous solution of hydrophobic agents, and thereafter the composite oxide particles are precipitated followed by drying and pulverization During the above hydrophobic treatment, it is preferable that the temperature during heating is at least 100° C. When the temperature is less than 100° C. during heating, composite oxide particles and hydrophobic agents tend to undergo incomplete condensation reaction.

As hydrophobic agents to be employed for the hydrophobic treatment, listed are silane coupling agents such as hexamethylsilazane, titanate based coupling agents, and those which are commonly employed as a surface treating agent, such as silicone oil, or silicone varnish. Further, also employed may be fluorine based silane coupling agents, fluorine based silicone oil, coupling agents having an amino group or a quaternary ammonium salt group, and modified silicone oil. It is preferable that these hydrophobic agents are employed in a state of dissolution in ethanol.

(Other Minute External additive Particles)

Minute external additive particles incorporated in the toner of the two component developer of the present invention are not limited only to the minute external additive particles described above, and other appropriate minute external additive particles may be employed in combination.

As other minute external additive particles may be various minute inorganic and organic particles, as well as lubricating agents such as titanate compounds or metal stearate salts It is preferable that as minute-inorganic particles, employed are, for example, minute particles of inorganic oxides such as silica, titania or alumina. Further, it is preferable that these minute inorganic particles are subjected to a hydrophobic treatment via silane coupling agents and titanium coupling agents. Further, as minute organic particles employed may be ball spherical ones at a number average diameter of the primary particles of about 10-about 2,000 nm. As the above minute organic particles employed may be polymers of polystyrene, polymethyl methacrylate, and styrene-methyl methacrylate copolymers.

As minute external additives other than the above, various ones may be employed in combinations (Adding Process of Minute External additive Particles)

Toner is prepared by adding the minute external additive particles described above to colored particles to form the target toner.

During addition of the minute external additive particles, as a mixing apparatus, which is employed to add the minute external additive particles, employed may be mechanical mixing apparatuses such as a Henschel mixer or a coffee mill.

(Addition Amount of Minute External Additive Particles)

The minute external additive particles are preferably added in an amount of 0.1-2.0% by weight with respect to the colored particles.

(Toner)

Toner which composes the two component developer of the present invention comprises colored particles and the minute external additive particles, and the former comprises, for example, a binder resin and a colorant.

(Manufacturing Method of Colored Particles)

Methods to manufacture colored particles, which constitute toner, are not particularly limited and listed may be a pulverization method, a suspension polymerization method, an emulsion polymerization aggregation method, a dissolution suspension method, and a polyester molecule elongation method, as well as other conventional methods.

(Suspension Polymerization Method)

The suspension polymerization method is carried out as follows. Toner constituting materials such as the releasing agent, the colorant and a radical polymerization initiator are added to a radical polymerizable monomer and dissolved or dispersed in the monomer by a sand grinder to prepare uniform monomer dispersion. After that, the above monomer dispersion is added into an aqueous medium, in which a dispersion stabilizer is previously added, and dispersed by a homomixer or an ultrasonic wave disperser to form oil droplets in the aqueous dispersion. The particle diameter of the droplet finally becomes the diameter of the toner particle. Therefore, the dispersing is controlled so that the diameter is made to desired size. The size of the dispersed droplet is preferably from 3 to 10 μm in the volume based median diameter. Thereafter, polymerization is performed by heating. After completion of the polymerization reaction, the dispersion stabilizer is removed and the resultant polymerized product is washed and dried to obtain colored particles. And then an external additive is added and mixed according to necessity. Thus toner particles can be obtained.

(Binder Resin)

When toner particles constituting the toner are produced by the crushing method or the dissolving suspension method, various kinds of known resin, for example, a vinyl type resin such as a styrene type resin, a (meth)acryl type resin, a styrene-(meth)acryl type copolymer resin, an olefin type resin, a polyester type resin, a polyamide type resin, a polycarbonate type resin, a polyether type resin, a poly(vinyl acetate) resin, a polysulfone resin, an epoxy resin, a polyurethane resin and a urea resin are usable as the binder resin for constituting the toner. These resins can be used singly or in combination of two or more kinds of them.

The releasing agent and the colorant are added to the resin and kneaded by a bi-axial kneader, pulverized and classified. Thus the toner particles can be obtained.

When the toner particles are prepared by the suspension polymerization method, mini-emulsion polymerization-coagulation method or emulsion polymerization-coagulation method, for example, the following can be used as the polymerizable monomer for forming the resin to obtain the resin for constituting the toner: A vinyl type monomer, for example, styrene or a styrene derivative such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene p-n-nonylstyrene, p-n-decylstyrene and p-n-dodecylstyrene; a methacrylate derivative such as methyl methacrylate, ethyl methacrylate, n-butyl methacrylate, iso-propyl methacrylate, iso-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate; an acrylate derivative such as methyl acrylate, ethyl acrylate, iso-propyl acrylate, n-butyl acrylate, t-butyl acrylate, iso-butyl acrylate, n-octyl acrylate, 2-ethylhexyl acrylate, stearyl acrylate, lauryl acrylate and phenyl acrylate; an olefin such as ethylene, propylene and iso-butylene, a vinyl halide such as vinyl chloride, vinylidene chloride, vinyl bromide, vinyl fluoride and vinylidene fluoride; a vinyl ester such as vinyl propionate, vinyl acetate and vinyl benzoate; a vinyl ether such as vinyl methyl ether and vinyl ethyl ether; a vinyl ketone such as vinyl methyl ketone, vinyl ethyl ketone and vinyl hexyl ketone; an N-vinyl compound such as N-vinylcarbazole, N-vinylindole and N-vinyl pyrrolidone; a vinyl compound such as vinylnaphthalene and vinylpyridine; and an acrylic acid or a methacrylic acid derivative such as acrylonitrile and acrylamide. These vinyl type monomers may be used singly or in combination of two or more kinds of them.

Moreover, a monomer having an ionic dissociable group is preferably used in combination with the above resin. The polymerizable monomer having an ionic dissociable group is one having a substituent such as a carboxyl group, a sulfonic acid group or a phosphoric group; concretely acrylic acid, methacrylic acid, maleic acid, itaconic acid, cinnamic acid, fumaric acid, a mono-alkyl maleate, a mono-alkyl itaconate, styrenesulfonic acid, allyl sulfosuccinate, 2-acrylamide-2-methylpropanesulfonic acid, acid phosphoxyethyl methacrylate and 3-chloro-2-acid phosphoxypropyl methacrylate are cited.

Furthermore, binder resins having crosslinked structure can be obtained by using a multifunctional vinyl compounds as the polymerizable monomer; concrete examples are divinylbenzene, ethylene glycol dimethacrylate, diethylene glycol diacrylate, diethylene glycol dimethacrylate, diethylene glycol diacrylate, triethylene glycol diacrylate, neopentyl glycol dimethacrylate and neopentyl glycol diacrylate.

(Surfactant)

When the toner particle constituting the toner is prepared by the suspension polymerization method, mini-emulsion method or the emulsion polymerization, the surfactant usable for obtaining the binder resin is not specifically limited. Ionic surfactants, for example, a sulfonic acid salt such as sodium dodecylbenzenesulfonate and sodium aryl-alkyl polyether sulfonate, sulfuric acid ester salt such as sodium dodecylsulfate, sodium tetradecylsulfate, sodium pentadecylsulfate, sodium pentadecylsulfate and sodium octylsulfate, a fatty acid salt such as sodium oleate, sodium laurate, sodium caprate, sodium caprylate, sodium capronate, potassium stearate and calcium oleate can be cited as suitable examples. A nonionic surfactant such as polyethylene oxide, polypropylene oxide, a combination of polypropylene oxide and polyethylene oxide, an ester of polyethylene glycol and a higher fatty acid, an alkylphenol polyethylene oxide, an ester of higher fatty acid and polypropylene oxide and a sorbitan ester is also usable. These surfactants are used as an emulsifying agent when the toner is produced by the emulsion polymerization but they may be used for another process and another purpose.

(Dispersion Stabilizer)

When the toner particles constituting the toner are produced by the suspension polymerization method, an easily removable inorganic compound may be also used as the dispersion stabilizer. As the dispersion stabilizer, tricalcium phosphate, magnesium hydroxide and hydrophilic colloidal silica can be exemplified, and tricalcium phosphate is particularly preferred. The dispersion stabilizers can be easily decomposed by an acid such as hydrochloric acid and easily removed from the surface of toner particle.

(Polymerization Initiator)

In the case of the suspension polymerization, an oil soluble radical polymerization initiator can be used. Examples of oil-soluble polymerization initiator include an azo type or diazo type polymerization initiator such as 2,2'-azobis-(2,4-dimethylvaleronitrile), 2,2'-azobis isobutyl nitrile, 1,1'-azobis(cyclohexane-1-carbonitrile), 2,2'-azobis-4-methoxy-2,4-dimethylvaleronitrile and azobisisobutyronitrile, a peroxide type polymerization initiator such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxicyclohexyl)propane and tris-(t-butyl peroxide), and a polymer initiator having a peroxide moiety at a side-chain thereof.

(Chain-Transfer Agent))

When the toner particles are produced by the suspension polymerization method, mini-emulsion method or emulsion polymerization method, usually used chain-transfer agent can be used for controlling the molecular weight of the binder resin.

As the chain-transfer agent, for example, a mercaptan such as n-octylmercaptan, o-decylmercaptan and tert-dodecylmercaptane, an aster of n-octyl-3 mercaptopropionic acid, terpinolene, carbon tetrabromide and α-methylstyrene dimer are usable, without any limitation.

(Colorant)

As the colorant constituting the toner, known inorganic and organic colorants can be used. Concrete colorants are listed below.

The following black colorants are employed, carbon black such as furnace black, channel black, acetylene black, thermal black, lamp black and further magnetic materials such as magnetite and ferrite.

Employed as magenta or red colorants may be C.I. Pigment Red 2, C.I. Pigment Red 3, C.I. Pigment Red 5, C.I. Pigment Red 6, C.I. Pigment Red 7, Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Employed as orange or yellow colorants may be C.I. Pigment Orange 31, C.I. Pigment Orange 43, C.I. Pigment 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, and C.I. Pigment Yellow 138 Employed as green or cyan colorants may be C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66, and C.I. Pigment Green 7.

The colorant may be used singly or in mixtures if necessary. The amount of the colorant is 1-30 wt %, preferably 2-20 wt % of the whole toner.

The colorant modified on the surface thereof may be used. As the surface modifying agent, a silane coupling agent, a titanium coupling agent and an aluminum coupling agent are preferably usable.

The releasing agent may be used in colored particles of the toner if required. Various kinds of wax can be employed. The amount of the releasing agent is 130 wt %, preferably 5-20 wt % by weight of the binder resin of the toner.

(Charge controlling Agent)

A charge controlling agent may be contained in the toner particles according to necessity. Various compounds can be used as the charge controlling agent.

(Diameter of Toner Particle)

The diameter of the toner particle is preferably from 3 to 8 μm in volume based median diameter. The particle diameter can be controlled by controlling the diameter of the dispersed oil droplet when the toner particle is formed by the suspension polymerization method.

When the volume based median diameter is within the range of from 3 to 8 μm, high reproducibility of fine lines and high quality of photographic images can be obtained, and the consumption of the toner can be reduced comparing with a toner having large diameter.

(Carrier)

The carrier is the resin dispersion type carrier comprising magnetic fine particles dispersed in a phenol-formaldehyde binder resin. The carrier particles have an average of the shape coefficient SF-1 of from 1.0 to 1.2 and an average of the shape coefficient SF-2 of from 1.1 to 2.5 and a volume based median diameter of from 10 to 100 μm. Magnetic Material Powder Magnetic material powder usable in the resin dispersion-type resin include, for example, powder containing a magnetic material such as iron, a ferrite represented by Formula (a), metal or a metal oxide such as a magnetite represented by Formula (b), an alloy of metal or a metal oxide thereof with metal such as aluminum.

$$MO.Fe_2O_3 \qquad \text{Formula (a)}$$

$$MFe_2O_4 \qquad \text{Formula (b)}$$

In Formulas (a) and (b), M represents a divalent or a monovalent metal such as manganese (Mn), iron (Fe), nickel (Ni), cobalt (Co), copper (Cu), magnesium (Mg), zinc (Zn) or lithium (Li). These metals may be used individually or in combination.

A magnetic material constituting the magnetic material powder includes, for example, magnetite, γ-ferric oxide, Mn—Zn ferrite, Ni—Zn ferrite, Mn—Mg ferrite, Ca—Mg ferrite, Li ferrite, and Cu—Zn ferrite.

The content of magnetic material powder in the resin dispersion-type carrier is from 40%-99% by weight, preferably 50%-70% by weight.

Further, the size of the magnetic material powder is preferably from 0.1 μm-0.5 μm in terms of a number average primary particle diameter. The number average primary particle diameter of the magnetic material powder refers to an arithmetic average value obtained by calculating measured Fere axis diameters of 100 magnetic material powder in an electron microscope photograph taken at a magnitude of 10,000.

To adjust magnetic properties, it is also possible to add nonmagnetic metal oxide powder formed employing the following nonmagnetic metals individually or in combination to the magnetic material powder. Specific examples of the nonmagnetic metals include Mg, Al, Si, Ca, Sc, Ti, V, Cr, Mn, Fe, Co, Ni, Cu, Zn, Sr, Y, Zr, Nb, Mo, Sn, and Ba. Further, specific examples of the nonmagnetic metal oxide powder include $Al_2O_3$, $SiO_2$, CaO, $TiO_2$, $V_2O_5$, $CrO_2$, $MnO_2$, $Fe_2O_3$, CoO, NiO, CuO, ZnO, SrO, $Y_2O_3$, and $ZrO_2$.

The size of the nonmagnetic metal oxide powder is preferably from 0.1 μm-1.0 μm in terms of a number average primary particle diameter.

The content of the nonmagnetic metal oxide powder in the resin dispersion-type carrier is from 10% to 60% by weight, preferably from 20% to 40% by weight.

In order to enhance oleophilic properties (hydrophobicity), it is also possible to apply treatment making oleophilic to the surface of the magnetic material powder using an agent giving oleophilic property. As the agent, coupling agents and higher fatty acids are exemplified. The amount of the agent added is preferably from 0.1 to 10 parts by weight, more preferably 0.2 to 6 parts by weight based on 100 parts by weight of the magnetic material powder.

(Production Method of Carrier)

The resin dispersion carrier can be produced by a method so called polymerization method.

The resin dispersion type carrier particles produced by the polymerization method have shape of near true sphere so that the carrier contamination is inhibited and uniformity of the surface and high charge donating ability can be obtained. The shape of the carrier can be easily controlled on the occasion of the production.

The carrier can be obtained, for example, by adding and dissolving or dispersing a phenol and an aldehyde as the raw material monomers and the magnetic fine particles into an aqueous medium which contains the dispersion stabilizer such as colloidal tricalcium phosphate, magnesium hydroxide and hydrophilic silica, and subjected to polymerization (addition condensation reaction) treatment in the presence of a basic catalyst.

As the basic catalyst to be used when the binder resin is the phenol-formaldehyde resin or the melamine resin, for example, ammonia water, and an alkylamine such as hexamethylenetetramine, dimethylamine, diethyltriamine and polyethyleneimine are applicable. The basic catalyst is preferably added in an amount of from 0.02 to 0.3 moles per mole of the phenol.

As the phenols to be used when the binder resin is the phenol-formaldehyde resin, an alkyl phenol such as phenol, m-cresol, p-tert-butylphenol, o-propylphenol, resorcinol and bisphenol A and a halogenated phenol such as one in which a part or whole of the alkyl group or the benzene ring is substituted by a chlorine atom or a bromine atom are applicable. Phenol is particularly preferable since high particle shape forming ability can be obtained.

As the aldehyde to be used when the binder resin is the phenol-aldehyde rein, formaldehyde in a form of formalin or paraformaldehyde and furfural are applicable, and formaldehyde is preferred.

The resin dispersion carrier may be one coated on the surface of resin dispersion carrier by a suitable resin selected for suiting the charging amount of the toner to obtain the optimum charging property and charging amount, and high durability.

When the resin dispersion carrier is coated with the covering resin, the amount of the covering resin is preferably from 0.1 to 10%, and more preferably from 0.3 to 5%, by weight of the resin dispersion carrier (core) of the resin coated carrier particles.

The coated amount and the state of the covering resin should be controlled so that an average of the shape coefficients SF-1 and SF-2 are each made to the foregoing values, respectively.

(Resins for Coating Carrier)

A thermoplastic or thermally curable insulating resin is suitably used as the covering resin. Concrete examples of the thermoplastic insulating resin include polystyrene, an acryl resin such as a copolymer of poly(methyl methacrylate) and a styrene-acrylic acid copolymer, a styrene-butadiene copolymer, vinyl chloride, vinyl acetate, a poly(vinylidene fluoride) resin, a fluorocarbon resin, a perfluorocarbon resin, a solvent-soluble perfluorocarbon resin, poly(vinyl alcohol), poly(vinyl acetal), polyvinylpyrrolidone, a petroleum resin, a cellulose derivative such as cellulose, cellulose acetate, cellulose nitrate, methyl cellulose, hydroxymethyl cellulose and hydroxypropyl cellulose, a novolak resin, low molecular weight polyethylene, a saturated alkyl polyester resin, an aromatic polyester resin such as poly(ethylene phthalate), poly(butylene phthalate) and polyallylate, a polyamide resin, a polyacetal resin, a polysulfone resin, a polyphenylene sulfide resin and a poly(ether ketone) resin.

Examples of the thermally curable insulating resin include a phenol resin, a modified phenol resin, a maleic resin, an alkyd resin, an epoxy resin and an acryl resin in concrete, an unsaturated polyester formed by condensation polymerization of maleic anhydride-terephthalic acid-polyvalent alcohol, urea resin, melamine resin, xylene resin, toluene resin, guanamine resin, melamine-guanidine resin, acetoguanamine resin, Glyptal resin, furan resin, silicone resin, polyimide, polyamidoimide resin, polyetherimide resin and polyurethane resin.

These covering resins may be used singly or in combination of two or more kinds of them. Moreover, it is allowed that a curing agent is mixed in the thermoplastic insulating resin for curing the coated resin.

As a method of coating of the coat resin on a core particle in which magnetic substance is dispersed in a resin, there may be a method of dissolving or dispersing a coat resin in an organic solvent so as to prepare a coat composition and coating the coat composition on carrier particles, and a method of merely mixing a coat resin powder with carrier parcels so as to adhere the coat resin on the carrier particles may be employed.

The carrier constituting the double-component developer is composed of the carrier particles having an average of the shape coefficient SF-1 of 1.0 to 1.2 and an average of the shape coefficient SF-2 of 1.1 to 2.5.

The shape coefficient SF-1 is an index indicating the spherical degree of a particle and is 1 when the particle is truly sphere. The shape coefficient SF-2 is an index indicating the degree of fine irregularity of the surface of a particle, and is 1 when the surface is smooth without any irregularity.

The shape coefficients SF-1 and SF-2 are defined according to the following formulae.

$$SF\text{-}1\{(\mathrm{MXLNG})^2/(\mathrm{AREA})\}\times(\pi/4) \qquad \text{Formula (SF-1)}$$

$$SF\text{-}2\{(\mathrm{PERI})^2/(\mathrm{AREA})\}\times(1/4\pi) \qquad \text{Formula (SF-2)}$$

In the above Formulas (SF-1) and (SF-2), MXLNG is the largest diameter of the carrier particle, AREA is the projection area of the carrier particle and PERI is the circumference length of the carrier particle.

The largest diameter is the width of the carrier particle for making largest the distance of a pair of parallel lines when the particle is put between these lines. The projection area is an area of the image of the carrier particle projected on a plane.

(Shape Coefficient of a Carrier Particle)

The average of the shape coefficients SF-1 and SF-2 is measured for carrier particles themselves, and when the carrier particles exist with other component such as toner particles or external additives, the carrier particles are isolated.

The two-component developer is mixed with a small amount of neutral detergent and deionized water well in a test cup, supernatant is cast away applying a magnet at the bottom of the test cup, then deionized water is added and supernatant is cast away again to remove toner and neutral detergent. Carrier particles are separated and dried at 40° C. Isolated carrier particles are obtained.

The shape coefficients can be obtained practically by randomly taking magnified photograph of 100 particles of the carrier by a field emission scanning electron microscope, and analyzing the photograph by an image processing analyzing apparatus LUZEX 3, manufactured by Nireco Corporation and then calculating the average values derived from the Formulas (SF-1) and (SF-2).

(Particle Diameter of Carrier)

The resin dispersion type carrier constituting the double-component of the invention has a volume based median diameter of from 10 to 100 μm, and preferably from 15 to 80 μm. The volume based median diameter of the resin dispersion type carrier can be typically measured by a laser diffraction type particle size distribution measuring apparatus HEROS, manufactured by Sympatec Co., Ltd., having a wet type dispersing device.

When the volume based median diameter of the resin dispersion type carrier is less than 10 μm, the ratio of fine particles in the distribution of carrier particles and easily imagewise adheres to the photoreceptor because the magnetic force per particle is lowered. When the volume based median diameter of the resin dispersion type carrier exceeds 100 μm, scattering of the toner is caused because the specific surface area of the carrier particle is reduced and the toner holding force is lowered.

The magnetization strength of the resin dispersion type carrier is preferably from 20 to 300 emu/cm$^3$ in a magnetic field of 1 kOe.

[Resistance of a Carrier]

The resin dispersion type carrier has preferably a slightly low resistance (electric resistance), fore example $10^9$ to $10^{14}$ Ωcm, more desirably $10^{10}$ to $10^{12}$ Ωcm. In the case that the resistance is controlled adequately, the recovery rate of undeveloped toner in a developing device is increased and it is effective to refrain the formation of so-called developing ghost, and the charge providing capability for toner is sufficient to charge toner, whereby fogging is minimized.

The resistance of the resin dispersion type carrier is obtained such that after carrier is left for one day night under a normal temperature and normal humidity environment (20° C./50% RH), the carrier is put into a cylinder having a bottom surface of 1 cm$^2$ and made of a resin, the top and bottoms of the cylinder is sandwiched between electrodes, a load of 1 Kg is applied on the cylinder, a voltage of 1,000V is applied between the electrodes, and an electric current is measured for 30 seconds, whereby a volume specific resistance can be measured.

The ratio of the toner in the double-component developer of the invention is from 3 to 20%, and preferably from 4 to 15%, by weight of the double-component developer.

The double-component developer of the invention can be suitably applied to various electrostatic image forming method, and particularly for forming full color images since the developer is low in the degradation thereof and the development can be stably performed for long period. In such the case, both of an image forming method by a four-cycle system constituted by four developing devices each relating to each of yellow, magenta, cyan and black, respectively, and one photoreceptor, and an image forming method by a tandem system in which image forming units each constituted by one color developing device and one photoreceptor are used for each of the colors can be applied.

When the double-component developer of the invention is applied for the full color image formation, the development can be stably performed for long period so that the color of the resultant color image can be stably maintained for long period.

The double-component developer of the invention is suitably applied for systems so called toner recycle system in which the toner remaining on the photoreceptor is recovered and returned to the developing apparatus and reused because the developer is difficultly subjected to stress.

<Image Formation Support>

Examples of image formation supports on which an image is formed in the above image forming method, include an ordinary paper from a thin paper to a thick paper, a high quality paper, an art paper or a print paper such as a coated paper, a Japanese paper, a post card, a plastic film for OHP, and a cloth, and the image formation support is not limited to these papers.

The two component developer comprises a carrier and a toner. The carrier has specific shape and resin dispersion type, which has high durability due to high fastness due to high cross-linking structure of comprising formaldehyde resin. The toner comprises external additive particles, in which a surface existing ratio of the silicon atoms in a surface of the external additive particles is larger than an existing ratio of the silicon atoms in an entirety of the external additive particles, whereby an accumulation of charge on the carrier particles since generation of excess charging is inhibited, and stable developability can be obtained over an extended period. It is possible as the result, to form high quality images of high resolution stably over an extended period since the external additive has sufficient charge ability.

The reason why the external additives in the toner inhibit excess charging despite its sufficient charge ability is estimated as follows. The external additive particles is easily charged by property of a compound comprising silicon atom such as silica existing in a surface of the external additive particles, and while sufficient charge is given by property to maintain charge easily, an excess charge is inhibited by charge leak to inside of particles due to titanium atom and/or aluminum atom existing inside of the particles.

Embodiments of this invention are detailed above, which may be modified in practical use.

EXAMPLES

The present invention is illustrated by the following examples.

Carrier Producing Example 1

To each of magnetite ($FeO.Fe_2O_3$) powder having a number average primary particle diameter of 0.24 μm and α-$Fe_2O_3$ powder having a number average primary average diameter of 0.60 μm, 0.55% by weight of a silane coupling agent (3-(2-aminoethylaminopropyl)dimethoxysilane) was added, respectively, and rapidly stirred at 100° C. in a stirring vessel for lyophilizing the each of the metal oxide fine particles to prepare oleophilic magnetite powder A and oleophilic α-iron oxide powder A.

Composition (1) composed of 60 parts by weight of the oleophilic magnetite powder A, 40 parts by weight of oleophilic a-iron oxide powder A, 10 parts by weight of phenol and 6 parts by weight of a formaldehyde solution containing 40% by weight of formaldehyde, 10% by weight of methanol and 50% of water was added to a flask containing an aqueous medium containing 28% by weight of $NH_4OH$ aqueous solution and heated by 85° C. spending for 40 minutes while stirring and subjected to thermally curing reaction for 3 hours while maintaining at this temperature and then cooled by 30° C. Water was further added and the supernatant was removed and remaining precipitate was washed by water, dried by air and further dried under reduced pressure of not more than 50 mmHg at 60° C. to obtain Resin Dispersion Carrier (c-1). The Resin Dispersion Carrier (c-1) had a volume based median diameter of 34 μm, an average of the shape coefficient SF-1 of 1.056 and an average of the shape coefficient SF-2 of 1.56. The strength of magnetization at 1 kOe was 130 emu/cm$^3$. The resistance was $2\times10^{10}$ Ωcm.

A resin coating solution containing 10% by weight of silicone resin KR9706 marketed by Shin-Etsu Chemical CO., Ltd., dissolved in toluene was prepared and the coating solution was coated on the Resin Dispersion Carrier (c-1) as the core by evaporating the solvent while continuously applying shearing stress to the coating solution so that the coated amount of the resin was 1.0% by weight. After that, the coated layer was cured for 1 hour at 200° C. and loosed, and then classified by a sieve of 20 meshes to obtain Resin Coated Dispersion Carrier CC-1 coated with the silicone resin on the surface thereof.

The Resin Coated Dispersion Carrier CC-1 had a volume based median diameter of 34 μm, an average of the shape coefficient SF-1 of 1.04 and an average of the shape coefficient SF-2 of 1.51. The strength of magnetization at 1 kOe was 129 emu/cm$^3$. The resistance was $3\times10^{11}$ Ωcm.

The volume based median diameter was measured by the laser diffraction type particle size distribution measuring apparatus HEROS, manufactured by Sympatec Co., Ltd., having a wet type dispersing device, and the shape coefficients SF-1 and SF-2 were determined by randomly taking magnified photograph of 100 particles of the carrier by a method described before. The strength of magnetization was measured by a vibration magnetic field type automatic magnetic property recording apparatus BHV-30, manufactured by Riken Denshi Co., Ltd.

Carrier Production Example 2

Resin Dispersion Carrier (c-2) was obtained in the same manner as in Carrier Producing Example 1 except that Composition (2) composed of 100 parts by weight of oleophilic magnetite powder A, 10 parts by weight of phenol and 6 parts by weight of a formaldehyde solution composed of 40% by weight of formaldehyde, 10% by weight of methanol and 50% of water was used in place of Composition (1). The Resin Coated Dispersion Carrier CC-2 was prepared in the same manner as in Carrier Producing Example 1 except that the amount of the coated resin is varied to 1.5% by weight.

The Resin Coated Dispersion Carrier CC-2 had a volume based median diameter of 39 μm, an average of the shape coefficient SF-1 of 1.10 and an average of the shape coefficient SF-2 of 1.15. The strength of magnetization at 1 kOe was 128 emu/cm$^3$. The resistance was $6\times10^{11}$ Ωcm.

Carrier Production Example 3

Resin Dispersion Carrier (c-3) was obtained in the same manner as in Carrier Producing Example 2 except that oleophilic magnetite B was used as the oleophilic magnetite powder, which is obtained by adding 4.5% by weight of the silane coupling agent (3-(2-aminoethylaminopropyl)-dimethoxysilane) to oleophilic magnetite powder and rapidly stirred and mixing at 100° C. in the mixing vessel for providing lyophilicity to the magnetite powder. The Resin Coated Dispersion Carrier CC-3 was obtained by using the Resin Dispersion Carrier (c-3) in the same manner as in Carrier Production Example 1. The resin dispersion type Carrier C-3 had a volume based median diameter of 41 μm, an average of the shape coefficient SF-1 of 1.04 and an average of the shape coefficient SF-2 of 1.95. The strength of magnetization at 1 kOe was 220 emu/cm$^3$. The resistance was $8\times10^{11}$ Ωcm.

Comparative Carrier Production Example 1

In a radical polymerizable monomer composition composed of 8 parts by weight of styrene, 2 parts by weight of 2-ethylhexyl acrylate, 1 part by weight of divinylbenzene, 60 parts by weight of the oleophilic magnetite powder A and 40 parts by weight of the oleophilic α-iron oxide A were dispersed and 0.3 parts by weight of a radical polymerization initiator, lauroyl peroxide, was added to prepare a carrier forming liquid.

On the other hand, 600 parts by weight of deionized water and 500 parts by weight of a 0.1 moles/L aqueous solution of $Na_3PO_4$ were charged in a 2 L four-mouth flask having a high speed mixing device TK type Homomixer, manufactured by Tokushu Kika Rogyo Co., Ltd., and a baffle plate, and heated by 65° C., and then 70 parts by weight of a 1.0 mol/L aqueous solution of $CaCl_2$ was gradually added while stirring at 14,000 rpm to prepare an aqueous medium containing extremely fine particle of sparingly soluble dispersion stabilizer of $Ca_3(PO_4)_2$. Then the carrier forming liquid was added into the aqueous medium and oil droplets of the carrier forming liquid were formed in the aqueous medium by stirring at 14,000 rpm by the high speed stirring device KT type Homomixer, manufactured by Tokushu Kika Kogyo Co., Ltd. After that, the stirrer was changed to a propeller type stirring wing and the system was heated by 75° C. and subjected to polymerization reaction for 8 hours. Then the system was cooled and hydrochloric acid was added to remove the dispersion stabilizer. Thereafter, the droplets were filtered, washed and dried to obtain the Resin Dispersion Carrier (c-4).

The Resin Coated Dispersion Carrier CC-4 was obtained in the same manner as in Carrier Production Example 1 using the Resin Dispersion Carrier (C-4) as the core particle.

The Resin Coated Dispersion Carrier CC-4 had a volume based median diameter of 44 μm, an average of the shape coefficient SF-1 of 1.05 and an average of the shape coefficient SF-2 of 1.31. The strength of magnetization at 1 kOe was 129 emu/cm$^3$. The resistance was $9\times10^{11}$ Ωcm.

Comparative Carrier Production Example 2

Comparative Carrier CC-5 composed of Li-ferrite particle prepared by a sintering method and coated with silicone resin KR9706 marketed by Shin-Etsu Chemical CO., Ltd., which had an average of the shape coefficient SF-1 of 1.30 and an average of the shape coefficient SF-2 of 2.52 was prepared. The volume based median diameter of this carrier was 45 μm. The resistance was $6\times10^{9}$ Ωcm.

Comparative Carrier Production Example 3

To 100 parts by weight of polyester resin having a softening point of 150° C., 900 parts by weight of magnetite powder having a number average primary particle diameter of 0.24 μm was added, and melted and kneaded by a biaxial extruder. Then the resultant matter was crushed by a mechanical crushing machine. Thus crushed powder having a volume based median diameter of 38 μm was obtained. The shape of crushed powder was made to sphere by heating at 180° C. for 5 seconds by an instantaneous heat treating apparatus and the resultant particles were coated by the silicone resin in the same manner as in Carrier Production Example 1 to prepare Comparative Carrier CC-6.

The Comparative Carrier CC-6 had a volume based median diameter of 39 μm, an average of the shape coefficient SF-1 of 1.02 and an average of the shape coefficient SF-2 of 1.04. The strength of magnetization at 1 kOe was 218 emu/cm$^3$. The resistance was $7\times10^{12}$ Ωcm.

Colored Particle Production Example Bk

Into a 2 L four-mouth flask provided with the high speed mixing apparatus TK type Homomixer, manufactured by Tokushu Kika Kogyo Co., Ltd., and a baffle plate, 600 parts by weight of deionized water and 500 parts by weight of a 0.1 mols/L $Na_3PO_4$ aqueous solution were charged and heated by 65° C. and then 70 parts by weight of a 1.0 mol/L aqueous solution of $CaCl_2$ was gradually added while stirring at 12,000 rpm to prepare an aqueous medium containing extremely fine particle of slightly soluble dispersion stabilizer of $Ca_3(PO_4)_2$.

On the other hand, 78 parts by weight of styrene, 22 parts by weight of 2-ethylhexyl acrylate, 7 parts by weight of carbon black, 10 parts by weight of pentaerythritol tetrabehenate ester were mixed and dispersion treated for 3 hours by an attritor, manufactured by Mitsui Kinzoku Co., Ltd., and then 8 parts by weight of 2,2'-azobis(2,4-dimethyl-valeronitrile) was added to prepare a toner forming polymerizable monomer composition.

The toner forming polymerizable monomer composition was added to the above aqueous medium and stirred at 12,000 rpm by the high speed stirring machine for 15 minutes under nitrogen atmosphere at an interior temperature of 65° C. to form toner particles. After that the stirring machine was replaced by a propeller wing stirrer, and the above resultant suspension was maintained at the same temperature for 10 hours while controlling the particle shape by the rotating rate of the stirrer wing and the angle of the baffle plate to complete the polymerization treatment After that, the suspension was cooled and diluted hydrochloric acid was added for removing the dispersion stabilizer, and then the suspended particles were separated and repeatedly washed and dried to obtain Colored Particle (Bk).

Colored Particle (Bk) had a volume based median diameter of 6.5 μm, a peak molecular weight of 14,000, a molecular weight distribution (Mw/Mn) of 8 and a softening point of 125° C.

The volume based median diameter was determined according to the particle size distribution within the range of from 2.0 to 40 μm measured by Coulter Multisizer, manufactured by Coulter Co., Ltd., using an aperture of 50 μm. The peak molecular weight and the molecular weight distribution were measured by gel permeation chromatography, and the softening point was measured by a Koka type (The Society of Polymer Science Japan Model) flow tester.

Colored Particle Production Example Y, M and C

Colored particles (Y), (M), and (C) were prepared in the same way as Colored Particle (Bk) except that carbon black was replaced by C.I. Pigment Yellow 74, C.I. Pigment Red 122 and C.I. Pigment Blue 15:3.

Minute External additive Particles Manufacturing Example 1

By employing the manufacturing facilities shown in FIG. 2, silicon tetrachloride vapor (A), titanium tetrachloride vapor (B), and aluminum chloride vapor (C) were introduced, together with inert gases, into a reaction chamber at a flow ratio (weight %) listed in the initial introduction amount column in Table 1, and a mixed gas which was prepared by mixing hydrogen and air at the specified ratio was combusted for 0.3 second at a combustion temperature of 2000° C., whereby composite particles incorporating silicon atoms, titanium atoms, and aluminum atoms were formed. After cooling, collection was carried out via a filter.

The composite particles, prepared as above, were heated at 500° C. for one hour in an oven under ambient air to remove chlorine, and 500 parts by weight of the resulting particles were placed in a high speed stirring and blending device fitted with a heating and cooling jacket. While stirring at 500 rpm, 25 parts by weight of deionized water was fed via spraying under sealed conditions, and stirring was carried out for an additional 10 minutes. Subsequently, 25 parts by weight of hexamethyldisilazane were added, and the resulting mixture was stirred for 60 minutes under sealed conditions. Thereafter, while stirring, nitrogen was passed at 150° C., and by removing formed ammonia gas and residual processing agents, Minute External additive Particles (1) composed of composite oxide particles were prepared.

Table 1 shows the value of $(R_1)/(R_2)$, the number average diameter of primary particles, the BET specific surface area, the bulk density, and the hydrophobic degree of the resulting minute external additive particles. Further, $(R_1)/(R_2)$ value, the number average diameter of primary particles, the BET specific surface area, the bulk density, and the hydrophobic degree refer to those determined based on determination procedures described above.

Minute External Additive Particles Manufacturing Examples 2-5

Minute External additive Particles (2)-(5) were prepared in the same manner as Minute External additive Particle Manufacturing Example 1, except that silicon tetrachloride vapor (A), titanium tetrachloride vapor (BY and aluminum chloride vapor (C) were introduced into a reaction chamber from the main route as initial stage raw materials of the reaction at the flow rate listed in the Initial Introduction Amount column in Table 1 and they were also introduced into the reaction chamber from another route (not shown) as later stage materials of the reaction at the flow rate listed in the Later Stage Introduction Amount column of Table 1, whereby composite particles incorporating silicon atoms, titanium atoms, and aluminum atoms were formed.

Table 1 shows the $(R_1)/(R_2)$, the number average diameter of primary particles, the BET specific surface area, the bulk density, and the hydrophobic degree of resulting Minute External additive Particles (2)-(5).

Minute External additive Particles (6)-(10) and (13)-(15) were prepared in the same manner as Minute External additive Particles Manufacturing Example 1, except that raw materials introduced into a combustion burner reaction furnace and their mixing ratio were changed as listed in Table 1.

Table 1 shows the $(R_1)/(R_2)$, the number average diameter of primary particles, the BET specific surface area, the bulk density, and the hydrophobic degree of resulting Minute External additive Particles (6)-(10) and (13)-(15).

Minute External Additive Particles Manufacturing Example 11

Titanium dioxide particles (t), prepared in the same manner as Minute External additive Particles Manufacturing Example 14, and silica particles (s), prepared in the same manner as Minute External additive Particles Manufacturing Example 13 were previously blended in a resin bag to result in 9:1 by weight. The resulting mixture was put into a tank 21A employing the manufacturing equipment described in FIG. 1, conveyed via an introducing pipe together with air as a carrier gas at a feeding rate of 4 kg/hour, and ejected to a burner 27 from nozzles. At that time, the nozzle ejection flow rate of air was 48 m/second. A mixture gas of oxygen and hydrogen is introduced from 21D into burner reactor 27, and burning reaction is conducted at a temperature of 1,000° C.

After the reaction, cooling air was introduced into the combustion furnace so that high temperature retention time in the combustion furnace was regulated to at most 0.3 second. Thereafter, manufactured fine powder (P) was collected employing a poly tetratfluoropolyethylene bag filter.

Collected fine powder (P) was subjected to a chlorine removing treatment by heating at 500° C. for one hour under an ambient air in an oven. Subsequently, 500 parts by weight of the resulting fine powder were placed in a high speed stirring and mixing device, and while stirring at 500 rpm, 25 parts by weight of deionized water was sprayed and fed under sealed conditions. Thereafter, stirring was continuously carried out for 10 minutes. Subsequently, 25 parts by weight of hexamethyldisilazane were added and stirring was carried out for 60 minutes under sealed conditions. Thereafter, stirring and heating were carried out. While passing 140° C. nitrogen, formed ammonia gas and residual processing agents were removed, whereby Minute External additive Particles (11) were prepared.

Table 1 shows the $(R_1)/(R_2)$, the number average diameter of primary particles, the BET specific surface area, the bulk density, and the hydrophobic degree of resulting of Minute External additive Particles (11).

Minute External Additive Particles Manufacturing Example 12

Minute External additive Particles (12) were prepared in the same manner as Minute External additive Particles Manufacturing Example 11, except that titanium dioxide particles (t) were replaced with aluminum oxide particles (a) prepared in the same manner as Minute External additive Particles Manufacturing Example 15.

Table 1 shows the $(R_1)/(R_2)$, the number average diameter of primary particles, the BET specific surface area, the bulk density, and the hydrophobic degree of resulting of resulting Minute External additive Particles (12).

TABLE 1

| | Preparation | Initial Introducing Amount (weight %) | | | Later Stage Introducing Amount (weight %) | | | Constituting Element (weight %) | | | | | | | BET (*4) | Bulk Density | Hydrophobic Degree |
|---|---|---|---|---|---|---|---|---|---|---|---|---|---|---|---|---|---|
| ** | Method | Si [A] | Ti [B] | Al [C] | Si [A] | Ti [B] | Al [C] | Si | Ti | Al | $R_1$ | $R_2$ | $R_1/R_2$ | *3 | ($m^2/g$) | (g/L) | (%) |
| 1 | *1 | 12 | 65 | 23 | — | — | — | 10 | 70 | 20 | 10.0 | 10.2 | 0.98 | 50 | 43 | 133 | 50 |
| 2 | *1 | 12 | 65 | 23 | 20 | 57 | 23 | 21 | 56 | 23 | 21.1 | 30.3 | 0.70 | 52 | 43 | 133 | 51 |
| 3 | *1 | 12 | 65 | 23 | 24 | 53 | 23 | 25 | 47 | 28 | 24.9 | 49.8 | 0.50 | 51 | 42 | 131 | 51 |
| 4 | *1 | 12 | 65 | 23 | 20 | 80 | — | 20 | 62 | 18 | 20.2 | 80.8 | 0.25 | 55 | 42 | 131 | 55 |
| 5 | *1 | 8 | 65 | 27 | 10 | 67 | 23 | 10 | 67 | 23 | 10.1 | 10.0 | 1.01 | 21 | 45 | 130 | 41 |
| 6 | *1 | 1.5 | 98.5 | — | — | — | — | 1 | 99 | — | 1.05 | 1.08 | 0.97 | 22 | 48 | 122 | 42 |
| 7 | *1 | 3 | 97 | — | — | — | — | 2.2 | 97.8 | — | 2.25 | 2.30 | 0.98 | 110 | 30 | 200 | 60 |
| 8 | *1 | 20 | 80 | — | — | — | — | 18.7 | 81.3 | — | 19.1 | 19.6 | 0.97 | 120 | 20 | 200 | 62 |
| 9 | *1 | 23 | 77 | — | — | — | — | 21.8 | 78.2 | — | 22.1 | 22.5 | 0.98 | 20 | 60 | 400 | 40 |
| 10 | *1 | 12 | — | 88 | — | — | — | 10 | — | 90 | 9.9 | 10.2 | 0.97 | 50 | 93 | 46 | 50 |
| 13 | *1 | 100 | — | — | — | — | — | 100 | — | — | 100.0 | 100.0 | 1.0 | 40 | 41 | 128 | 45 |
| 14 | *1 | — | 100 | — | — | — | — | — | 100 | — | 0.0 | 0.0 | — | 21 | 43 | 131 | 41 |
| 15 | *1 | — | — | 100 | — | — | — | — | — | 100 | 0.0 | 0.0 | — | 15 | 87 | 50 | 35 |

| | Preparation | Initial Introducing Amount (weight %) | | | Later Stage Introducing Amount (weight %) | | | Constituting Element (weight %) | | | | | | | BET (*4) | Bulk Density | Hydrophobic Degree |
|---|---|---|---|---|---|---|---|---|---|---|---|---|---|---|---|---|---|
| ** | Method | (s*) | (t*) | (a*) | (s*) | (t*) | (a*) | Si | Ti | Al | $R_1$ | $R_2$ | $R_1/R_2$ | *3 | ($m^2/g$) | (g/L) | (%) |
| 11 | *2 | 10 | 90 | — | 40 | 60 | — | 25 | 75 | — | 25.2 | 40.3 | 0.63 | 55 | 42 | 130 | 55 |
| 12 | *2 | 10 | — | 90 | 40 | — | 60 | 25 | — | 75 | 25.0 | 40.0 | 0.63 | 57 | 42 | 130 | 56 |

**: Minute External Additive Agent Particles No.

*1: gas phase method via vapor.

*2: gas phase method employing powers.

*3: Number Average Diameter of Primary Particles (nm)

BET (*4): BET Specific Surface Area.

(s*): Silica particles obtained by Preparation method No. 13.

(t*): Titanium dioxide particles obtained by Preparation method No. 14.

(a*): Aluminum oxide particles obtained by Preparation method No. 15.

Toner Manufacturing Examples Bk1-Bk15

Each of Minute External additive Particles (1)-(15) was mixed with Colored Particles (Bk) to reach the added amount listed in Table 2 by employing Henschel mixer, whereby each of Toners (Bk1)-(Bk15) was prepared. The shape and diameter of these toner particles resulted in no change by the addition of minute external additive particles.

Toners (Bk1)-(Bk4) and (Bk6)-(Bk12) are those which relate to the present invention, while Toners (Bk5) and (Bk13)-(Bk15) are comparative toners.

TABLE 2

| Toner No. | External Additive No. | External Additive Added amount (% by weight) |
|---|---|---|
| Bk 1 | 1 | 0.8 |
| Bk 2 | 2 | 0.8 |
| Bk 3 | 3 | 0.8 |
| Bk 4 | 4 | 0.8 |
| Bk 5 | 5 | 0.8 |
| Bk 6 | 6 | 0.8 |
| Bk 7 | 7 | 1.5 |
| Bk 8 | 8 | 1.5 |
| Bk 9 | 9 | 0.8 |
| Bk 10 | 10 | 0.8 |
| Bk 11 | 11 | 0.8 |
| Bk 12 | 12 | 0.8 |
| Bk 13 | 13 | 0.8 |
| Bk 14 | 13 + 14 | 0.4 + 0.4 |
| Bk 15 | 13 + 15 | 0.4 + 0.4 |

Toner Manufacturing Examples Y1-Y15

Each of Toners (Y1)-(Y15) was prepared in the same manner as Toner Manufacturing Examples Bk1-Bk15, except that Colored Particles (Bk) were replaced with Colored Particles (Y).

Toners (Y1)-(Y4) and (Y6)-(Y12) are those which relate to the present invention, while Toners (Y5) and (Y13)-(Y15) are comparative toners.

Toner Manufacturing Examples M1-M15

Each of Toners (M1)-(M15) was prepared in the same manner as Toner Manufacturing Examples Bk1-Bk15, except that Colored Particles (Bk) were replaced with Colored Particles (M).

Toners (M1)-(M4) and (M6)-(M12) are those which relate to the present invention, while Toners (M5) and (M13)-(M15) are comparative toners.

Toner Manufacturing Examples C1-C15

Each of Toners (C1)-(C15) was prepared in the same manner as Toner Manufacturing Examples Bk1-Bk15, except that Colored Particles (Bk) were replaced with Colored Particles (C).

Toners (C1)-(C4) and (C6)-(C12) are those which relate to the present invention, while Toners (C5) and (C13)-(C15) are comparative toners.

Two Component Developer Manufacturing Examples Ek1-Bk18

Each of Two Component developers (Bk1)-(Bk18) was prepared by blending carriers CC-1 to CC-6 as described in Table 3 so that the toner concentration reached 6%.

TABLE 3

| Developer No. | Toner No. | Carrier No. |
|---|---|---|
| 1 | Bk 1 | CC-1 |
| 2 | Bk 2 | CC-2 |
| 3 | Bk 3 | CC-3 |
| 4 | Bk 4 | CC-1 |
| 5 | Bk 6 | CC-2 |
| 6 | Bk 7 | CC-3 |
| 7 | Bk 8 | CC-1 |
| 8 | Bk 9 | CC-2 |
| 9 | Bk 10 | CC-3 |
| 10 | Bk 11 | CC-1 |
| 11 | Bk 12 | CC-2 |
| 12 | Bk 12 | c-1 |
| 13 | Bk 5 | CC-1 |
| 14 | Bk 13 | CC-1 |
| 15 | Bk 14 | CC-1 |
| 16 | Bk 15 | CC-1 |
| 17 | Bk 3 | CC-4 |
| 18 | Bk 3 | CC-5 |
| 19 | Bk 3 | CC-6 |

Two Component Developer Manufacturing Examples Y1-Y18, M1-M18, and C1-C18

Each of Two Component developers (Y1)-(Y18), (M1)-(M18), and (C1)-(C18) was prepared in the same manner as (Bk1)-(Bk18), except that toners (Y1)-(Y15), (M1)-(M15) and (C1)-(C15) were respectively employed in place of toners (Bk1)-(Bk18).

Examples 1-18

Tow Component Developers (Bk1)-(Bk18), (Y1)-(Y18), (M1)-(M18), and (C1)-(C18) were employed in combinations as described in Table 4. Digital copier "bizhub PRO C500" (produced by Konica Minolta Business Technologies Inc.) was employed to evaluate image density, for density and color reproduction.

A test color image at a pixel ratio of 1% was printed onto 500,000 image supports of an A4 size in one sheet intermittent mode, and background density and toner scattering were evaluated, under a condition of normal temperature and low humidity (20° C. and 10% RH), and evaluation was conducted for the initial print and 500,000th print.

A test image comprises 2×2 cm patch images of color images of yellow, magenta, cyan, blue, green and red, a solid white image and a solid black image were printed out on an A4 size sheet. Color reproduction was evaluated by the color images, image density was measured by the solid black image and fog density was measured by the white solid image.

Color reproduction was evaluated in such a manner that color reproduction area was measured by L*a*b* color space chart obtained by each yellow, magenta, cyan, blue, green and red patch by employing colorimeter CM-2002, manufactured by Konica Minolta Sensing Inc. Each of the color reproduction area of 500,000th print sheet was evaluated taking the color reproduction area of initial test print as 100.

A reflection density of the black solid image area and white solid area was measured via a reflection densitometer, RD-918 (produced by Macbeth Corp.). The average of reflection density measured at 10 points selected arbitrary on a solid black area was represented by a relative value, based on the absolute reflection density of paper being 0. The average of reflection density measured at 10 points selected arbitrary on a solid white area was represented by an absolute value, based on the absolute reflection density of paper being 0.

Change of color reproduction within 90 is sufficient for practical use. Image density of 1.30 or more is sufficient, and fog density of 0.005 or less is sufficient for practical use.

TABLE 4

| | Developer No. | | | | Image Density | | Fog Density | | Color |
|---|---|---|---|---|---|---|---|---|---|
| Sample No. | Bk | Y | M | C | Initial | 500,000th print | Initial | 500,000th print | Reproduction Area |
| 1 | 1 | 1 | 1 | 1 | 1.41 | 1.31 | 0.000 | 0.004 | 95 |
| 2 | 2 | 2 | 2 | 2 | 1.41 | 1.39 | 0.000 | 0.003 | 98 |
| 3 | 3 | 3 | 3 | 3 | 1.41 | 1.40 | 0.000 | 0.002 | 99 |
| 4 | 4 | 4 | 4 | 4 | 1.41 | 1.41 | 0.000 | 0.001 | 99 |
| 5 | 5 | 5 | 5 | 5 | 1.41 | 1.35 | 0.000 | 0.004 | 96 |
| 6 | 6 | 6 | 6 | 6 | 1.41 | 1.37 | 0.000 | 0.003 | 97 |
| 7 | 7 | 7 | 7 | 7 | 1.41 | 1.37 | 0.000 | 0.003 | 97 |
| 8 | 8 | 8 | 8 | 8 | 1.41 | 1.35 | 0.000 | 0.004 | 96 |
| 9 | 9 | 9 | 9 | 9 | 1.41 | 1.34 | 0.000 | 0.004 | 96 |
| 10 | 10 | 10 | 10 | 10 | 1.41 | 1.39 | 0.000 | 0.003 | 96 |
| 11 | 11 | 11 | 11 | 11 | 1.41 | 1.39 | 0.000 | 0.003 | 98 |
| 12 | 11 | 11 | 11 | 11 | 1.34 | 1.31 | 0.000 | 0.005 | 92 |
| 13 | 12 | 12 | 12 | 12 | 1.41 | 1.26 | 0.000 | 0.009 | 91 |
| 14 | 13 | 13 | 13 | 13 | 1.40 | 1.25 | 0.000 | 0.011 | 89 |
| 15 | 14 | 14 | 14 | 14 | 1.40 | 1.25 | 0.000 | 0.011 | 89 |
| 16 | 15 | 15 | 15 | 15 | 1.40 | 1.25 | 0.000 | 0.011 | 89 |
| 17 | 16 | 16 | 16 | 16 | 1.41 | 1.20 | 0.000 | 0.012 | 85 |
| 18 | 17 | 17 | 17 | 17 | 1.41 | 1.20 | 0.000 | 0.012 | 85 |
| 19 | 18 | 18 | 18 | 18 | 1.41 | 1.20 | 0.000 | 0.012 | 85 |

The result summarized in Table 4 demonstrate that fog density is minimized in the formed image after long time use as well as sufficient image density is obtained, and further wide color reproduction is attained for the samples 1-11 according to this invention.

What is claimed is:

1. A two component developer comprising a toner and a carrier, wherein carrier particles of the carrier comprise magnetic material powder dispersed in a phenol-formaldehyde resin, and have an average shape coefficient SF-1 of 1.0 to 1.2 and an average shape coefficient SF-2 of 1.1 to 2.5, and a volume based median diameter of from 10 to 100 μm;

the toner comprises colored particles and external additive particles, wherein the external additive particles comprise a complex oxide containing silicon atoms and at least one of titanium atoms and aluminum atoms, and $(R_1)/(R_2)$ is less than 1, wherein $(R_1)$ is an average existing ratio of the silicon atoms in an entirety of the external additive particles defined as a value obtained from a weight of silicon atoms in the entirety of the external additive particles divided by the total weight of the silicon atoms, the titanium atoms and the aluminum atoms in the entirety of the external additive particles, and $(R_2)$ is a surface existing ratio of the silicon atoms in a surface of the external additive particles defined as a value obtained from a weight of silicon atoms in the surface divided by the total weight of the silicon atoms, the titanium atoms and the aluminum atoms in the surface.

2. The two component developer of claim 1, wherein $(R_1)/(R_2)$ is not more than 0.7.

3. The two component developer of claim 1, wherein $(R_1)/(R_2)$ is not more than 0.5.

4. The two component developer of claim 1, wherein $(R_1)/(R_2)$ is not more than 0.25.

5. The two component developer of claim 1, wherein the average existing ratio of the silicon atoms $(R_1)$ is from 1 to 20 weight %.

6. The two component developer of claim 1, wherein an number average diameter of primary particles of the external additive particles is 20 to 200 nm.

7. The two component developer of claim 1, wherein the external additive particles have a BET specific surface area of 2-100 $m^2/g$.

8. The two component developer of claim 1, wherein the external additive particles have a bulk density of 100-400 g/L.

9. The two component developer of claim 1, wherein the external additive particles have a degree of hydrophobicity of 30% or more.

* * * * *